United States Patent [19]

Kennedy et al.

[11] 4,432,816

[45] Feb. 21, 1984

[54] PYROTECHNIC COMPOSITION FOR CUTTING TORCH

[75] Inventors: Katherine L. Kennedy; Paul W. Proctor, both of White Plains; Robert L. Dow, LaPlata, all of Md.

[73] Assignee: The United States of America as represented by the Secretary of the Navy, Washington, D.C.

[21] Appl. No.: 440,482

[22] Filed: Nov. 9, 1982

[51] Int. Cl.[3] ..... C06B 45/10

[52] U.S. Cl. ..... 149/19.3; 149/2; 149/37

[58] Field of Search ..... 149/19.3, 37, 2

[56] References Cited

U.S. PATENT DOCUMENTS

| | | | |
|---|---|---|---|
| 3,152,935 | 10/1964 | Cadwallader | 149/19.3 |
| 3,309,249 | 3/1967 | Allen | 149/19.1 |
| 3,325,316 | 6/1967 | MacDonald | 149/37 |
| 3,513,043 | 5/1970 | Burnside | 149/19.3 |
| 3,671,341 | 6/1972 | Dierolf | 149/19.3 |
| 3,695,951 | 10/1972 | Helms et al. | 149/44 |
| 3,753,811 | 8/1973 | Julian et al. | 149/19.3 |
| 3,890,174 | 6/1975 | Helms et al. | 149/37 |
| 4,000,022 | 12/1976 | Beckert et al. | 149/37 |
| 4,152,988 | 5/1979 | Haas et al. | 149/19.3 |
| 4,349,396 | 9/1982 | Mueller et al. | 149/19.3 |

*Primary Examiner*—Edward A. Miller

[57] ABSTRACT

A composition for a cutting touch for quickly breaching a munition casing and burning out the energetic material therein consists essentially from about 15 to about 20 weight percent of aluminum, from about 5 to about 10 weight percent of the copolymer of vinylidene fluoride and hexafluoropropylene, up to about 0.6 weight percent of graphite and the remainder of ferric oxide.

6 Claims, No Drawings

PYROTECHNIC COMPOSITION FOR CUTTING TORCH

BACKGROUND OF THE INVENTION

The invention pertains generally to ordnance disposal and in particular to pyrotechnic torches for burning out dudded munitions.

Often dudded munitions cannot be safely disposed of by detonation. Burning out the munition offers a nonviolent technique for disposing these munitions on site. Since munitions are often one-half inch thick steel enclosures of up to two thousand pounds of a heat-sensitive, gas-generating, energetic material, gaining access through the steel casing without detonating the explosive or solid propellant is extremely difficult.

Conventional metal-cutting torches are difficult to operate remotely, often do not cut quickly enough if the metal casing is steel to prevent cook off and detonation, and are expensive. They are particularly difficult to operate remotely under water.

Torches utilizing thermite powder (a mixture of a metal and a metal oxide) are unreliable because the powder or the molten metals often plug the exhaust or cutting ports of the torches. Further, these torches are very unreliable under water, sometimes detonating, and degrade upon exposure to moisture, causing unreliable performance.

The most successful torches, to date, utilize a pyrotechnic composition disclosed in Helms et al., U.S. Pat. No. 3,695,951, which comprises nickel, aluminum, ferric oxide, and powdered tetrafluoroethylene. The problems with these torches are the expense of nickel, the inability to solvent-process the composition, a high firing shock due to the generation of a high thrust immediately after achieving maximum pressure, sensitivity to moisture, and some reproducibility difficulties.

Numerous other energetic compositions are known, but are not suitable in metal-cutting torches for ordinance disposal because their thrust is too high, their heat generation is too slow, or their shelf life is too short. They are, however, useful for many other applications. The following are examples of energetic compositions and some of their uses.

A metal in a halogenated hydrocarbon binder has been used as a flare and in an electric match. The flare composition of Edgar Cadwallader, U.S. Pat. No. 3,152,935, comprises aluminum and trifluorochloroethylene. In Haas et al., U.S. Pat. No. 4,152,988, the igniter composition in an electric match comprises magnesium, two types of polytetrafluoroethylene, and a fluorocarbon rubber.

An energetic compositions comprising a metal, a metal oxide, and an organic binder have many uses. In Arthur Dierolf, U.S. Pat. No. 3,671,341, an energetic composition consisting of uranium, mercuric oxide, Viton A, and teflon is used in rocket propellant. The rocket-propellant composition of Paul Allen, U.S. Pat. No. 3,309,249 consists of aluminum, ferric oxide, and a non-halogenated binder.

Other energetic compositions have a mixture of a metal and an oxidizing salt in a halogenerated hydrocarbons. The igniter composition of Julian et al., U.S. Pat. No. 3,753,811, consists of aluminum, an oxidizing salt, a fluoride salt, polytetrafluoroethylene, and polytrifluorochloro-ethylene. Burnside, U.S. Pat. No. 3,513,043, discloses a propellant composition comprising aluminum, oxidizing salt, polyfluoroethylene resin, Viton A, and other minor ingredients.

SUMMARY OF THE INVENTION

It is, therefore, an object of the present invention to reduce firing shock of pyrotechnic torches.

Another object of this invention is to solvent process an energetic composition to produce a charge for a pyrotechnic torch.

Another object is to decrease the cost of pyrotechnic torches while increasing their reliability and shelf life.

A further object of this invention is to provide an pyrotechnic torch which ignites easily but is not susceptible to accidental ignition.

A still further object of this invention is to provide a pyrotechnic composition which can be stored in a humid atmosphere for a long period of time and can be used reliably under water.

These and other objects are achieved by ferric oxide and aluminum powder in a compatable, soluble, fluoroelastomer binder having certain reaction characteristics.

DETAILED/DESCRIPTION OF THE INVENTION

The pyrotechnic composition of this invention consists essentially from about 15 to about 20 weight percent of aluminum, from about 5 to about 10 weight percent of the copolymer of vinylidene fluoride and hexafluoropropylene, and the remainder of ferric oxide. The preferred composition consists essentially from 18.8 to 19.2 weight percent of aluminum, from 7.8 to 8.2 weight percent of the copolymer of vinylidene fluoride and hexafluoropropylene, and the remainder of ferric oxide. If the composition is to be pressed into pellets, graphite in an amount up to 0.6 weight percent and preferably from 0.3 to 0.5 weight percent can be added to lubricate the pellet press dies during the pressing operation.

The metal powders do not have to have a high degree of purity, which reduces the cost of the pyrotechnic torch. Instead of using technical grade iron oxide, ground hematite iron ore, 98% $Fe_2O_3$, can be used at a considerable cost savings.

The particle size of aluminum should not be larger than about 100 mesh size and the particle size of the ferrice oxide is not larger than about 200 mesh size and is not smaller than one micrometer.

The fluoroelastomer binder is a copolymer of vinylidene fluoride and hexafluoropropylene. A satisfactory, commercially available copolymer is sold under the Trademark of Viton A. The molecular weight can be as high as 150,000, the Mooney viscosity is from about 35 to 45, a Williams plasticity is about 110, a specific gravity is about 1.85, and a fluorine content is about 65 percent. Another satisfactory, commercially available copolymer is sold under the Trademark of Viton C which has a lower viscosity (Mooney viscosity of 10).

This particular binder has proven critical to the operation of the invention. It degrades the flame temperature less than any other binder, including Teflon, and oxidizes some of the aluminum, giving a higher energy exhaust product, has a high density, is easily pelletized, has a long shelf life, and provides excellent water repellancy. The amount of gas by the combustion thereof is less than that for other binder materials. The binding capacity of this elastomer is extremely high, allowing the charge, pelletized or otherwise, to withstand a considerable crushing force before crumbling.

The charge for a pyrotechnic torch is prepared by dissolving the copolymer in a suitable solvent, e.g. acetone, mixing in the powders to form a slurry and drying to a frangible solid. It is preferred that the slurry is submerged in hexane while mixing is continued in order to improve the coating of the powder particles. If very high-shear mixing is used, each powder particle can be coated with a thin coating of the binder. Final processing includes breaking up the frangible solid and pressing the powder into pellets or extruding the powder into strands which can be broken up into pellets. The molding powder can be formed into unitary grains of any configuration. However, the pellet form is preferred because the pellets eliminate the need for the many operations and high labor and inspection requirements associated with a unitary grain. In addition to the much lower material costs (no nickel and an inexpensive grade of iron oxide), the present energetic composition has the advantages of not requiring a unitary charge and of solvent processing over previous compositions.

Since the total surface area of the charge is a major factor to the burning rate, the surface area of a pellet should not exceed 2.8 sq. cm if the pellet form is to be used in a cutting torch for disposing munitions. Very small pellets or particles can present clogging problems for the torch. Accordingly it is preferred that the pellets have at least a surface area of about 1.8 sq. cm. It is also preferred that the maximum surface area is not greater than 2.5 sq. cm.

Having described the invention in general, the following examples are given to illustrate the practice and advantages thereof. It is understood that the examples are given by way of illustration and are not meant to limit this disclosure or the claims to follow in any manner.

EXAMPLE I

Preparation of Pyrotechnic Pellets

The copolymer of vinylidene fluoride and hexafluoropropylene sold under the Trademark of Viton A, was dissolved in acetone. For ferric oxide, ground hematite iron ore was used. The iron oxide and aluminum powder with an $Fe_2O_3$: Al particle size ratio of 10:1 were added to make a slurry. The three ingredients were added in the following weight percentages: 8 for Viton A, 73 for $Fe_2O_3$, and 19 for Al. Additional acetone was added when the slurry became too dry during the powder addition.

The slurry was poured onto a revolving Cowles dissolver blade submerged in hexane. The combination of slurry breakup and the hexane submersion shock-gelled the Viton A onto the individual metal particles. The agitation was continued until the average agglomerate size of about three millimeters of the coated powder, referred to as molding powder, was obtained. The agitation was stopped and the molding powder settled rapidly to the bottom. Additional hexane washes were made to remove the residual acetone by solvent extraction. Two hexane washes were needed to remove the soft or doughy feeling on touch from agglomerates of molding powder. The molding powder was air-dried to evaporate residual hexane before use. The powder was formed into pellets of 0.48 cm. diameter by 0.8 cm. using a stokes 10-ton press, Model 515-3 Automatic Pellitizer with standard dies. In order to reduce wear on the pelletizer, approximately 0.5 weight percent graphite was mixed with the molding powder. Comparative tests showed that the graphite had no effect on the performance of the charge.

EXAMPLE II

Testing The Pyrotechnic Pellets

The pyrotechnic pellets were admixed with about six weight percent of standard ignition pellets consisting of magnesium, Viton A, and Teflon and the uniform mixture was used to charge an MK 2 MOD O cutting torch. The ignition pellets were ignited by means of a Holex 1122A squib.

Several firings were made, including one with 1200 pellets. All firings were uniform in ignition and burning. Pressure-time curves were made for each firing, along with thrust measurement. These data and cutting speed were compared with the pyrotechnic charge disclosed in Helms et al. (U.S. Pat. No. 3,695,951) referred to as pyronol.

A pressure of about 1800 psig, achieved quickly for about one second, compares with that for pyronol. The cutting speeds for the two were about the same. The pyronol charge had a higher thrust and it came early in the operating cycle, whereas the subject charges had a lower thrust (from $\frac{1}{3}$ to $\frac{1}{2}$ of that of the pyronol) and it came late in the operating cycle when the pressure was low. These differences eased greatly firing-stand shock.

The reproducibility of the burning was significantly better than that of pyronol. The pellets of this invention had considerably more strength than the pyronol pellets. The pyronol pellets crumbled if pressed between two fingers, but the subject pellets did not. To test the water resistance of the pellets, the subject pellets and pyronol pellets were dipped in water and then were ignited. The subject pellets ignited immediately without any loss in performance but the pyronol would not ignite.

The advantages of lower cost, lower thrust, better burning reproductibility make the pyrotechnic charge of this invention an important improvement over present techniques. Further, the present charges have been proven to be moisture resistant and are predicted to have a shelf life of several years.

Obviously, many modification and variations of the present invention are possible in light of the above teachings. It is therefore to be understood that, within the scope of the appended claims, the invention may be practiced otherwise than as specifically described.

What is claimed is:

1. An energetic composition consisting essentially of from about 15 to about 20 weight percent of aluminum, from about 5 to about 10 weight percent of the copolymer of vinylidene fluoride and hexafluoropropylene, and the remainder of iron oxide powder which is substantially ferric oxide.

2. The composition of claim 1 wherein the amount of aluminum is from 18.8 to 19.2 weight percent and the amount of the copolymer of vinylidine fluoride and hexafluoropropylene is from 7.8 to 8.2 weight percent.

3. The composition of claim 2 wherein the amount of aluminum is 19 weight percent and the amount of the copolymer of vinylidene fluoride and hexafluoropropylene is eight percent.

4. A pyrotechnic pellet having a surface area not in excess of 2.8 sq.cm. and consisting essentially of from about 18.5 to about 19.5 weight percent of aluminum, from about 7.5 to about 8.5 weight percent of the copolymer of vinylidene fluoride and hexafluoropropylene from 0 to about 0.6 weight percent of graphite, and the remainder iron oxide powder which is substantially ferric oxide.

5. The pyrotechnic pellet of claim 4 having a surface area from 1.8 to 2.5 sq.cm. and having an amount of aluminum from 18.8 to 19.2 weight percent, an amount of the copolymer of vinylidene fluoride and hexafluoropropylene, and an amount of graphite from 0.3 to 0.5 weight percent.

6. The pyrotechnic pellet of claim 5 wherein the amount of aluminum is 19 weight percent and the amount of the copolymer of vinylidene fluoride and hexafluoropropylene is eight percent.

* * * * *